US011492024B2

(12) United States Patent
Bowker et al.

(10) Patent No.: US 11,492,024 B2
(45) Date of Patent: Nov. 8, 2022

(54) LONG RAIL TRANSPORT TRAIN

(71) Applicants: Allison L. Bowker, Dallas, TX (US); Roger W. Roby, Plano, TX (US); James W. V. Tabije, Grand Prairie, TX (US)

(72) Inventors: Allison L. Bowker, Dallas, TX (US); Roger W. Roby, Plano, TX (US); James W. V. Tabije, Grand Prairie, TX (US)

(73) Assignee: BNSF Logistics, LLC, Springdale, AR (US)

( * ) Notice: Subject to any disclaimer, the term of this patent is extended or adjusted under 35 U.S.C. 154(b) by 826 days.

(21) Appl. No.: 16/419,702

(22) Filed: May 22, 2019

(65) Prior Publication Data

US 2020/0369299 A1 Nov. 26, 2020

(51) Int. Cl.

| | |
|---|---|
| ***B61D 3/00*** | (2006.01) |
| ***B61D 3/16*** | (2006.01) |
| ***E01B 29/17*** | (2006.01) |
| ***B61D 47/00*** | (2006.01) |
| ***B61D 3/08*** | (2006.01) |

(52) U.S. Cl.

CPC ..... *B61D 3/16* (2013.01); *B61D 3/08* (2013.01); *B61D 47/00* (2013.01); *E01B 29/17* (2013.01)

(58) Field of Classification Search

CPC ..... B60P 1/52; B60P 3/40; B60P 7/12; B61D 3/08; B61D 47/00; B61D 45/003

USPC ..... 410/32, 33, 44, 45; 105/392

See application file for complete search history.

(56) References Cited

U.S. PATENT DOCUMENTS

| | | | | |
|---|---|---|---|---|
| 1,704,269 | A * | 3/1929 | Wattmann | E01B 29/17 104/5 |
| 3,288,082 | A | 11/1966 | Brosnan | |
| 3,366,258 | A | 1/1968 | Cox | |
| 5,323,711 | A * | 6/1994 | Stephenson, Jr. | B61D 3/08 105/422 |
| 5,361,704 | A * | 11/1994 | Bounds | E01B 29/05 104/6 |
| 5,630,365 | A | 5/1997 | Hertelendi | |

(Continued)

FOREIGN PATENT DOCUMENTS

WO WO 2018/219707 A1 6/2018

OTHER PUBLICATIONS

International Search Report, World Intellectual Property Office, US Patent Office search authority, PCT patent application No. PCT/US2020/033579, dated Aug. 4, 2020.

*Primary Examiner* — Stephen T Gordon

(74) *Attorney, Agent, or Firm* — Dan Brown Law Office; Daniel R. Brown

(57) ABSTRACT

A railcar consist of flatcars for transporting continuous rail sections configured for top loading and end unloading of the rail sections. The consist includes a tie-down flatcar and plural support flatcars. The tie-down flatcar includes a rail securement rack with plural removable rail clamping shelves that facilitate top loading and clamping of the rail sections in place. Each of the plural support flatcars have a roller rack fixed to it. The roller racks include plural roller shelves with rollers to support the rail sections. The roller shelves are pivotally mounted to the roller racks between a loading position that provides clearance for placement of the rail sections from above the consist, and a transport position that supports the rail sections.

14 Claims, 11 Drawing Sheets

(56) References Cited

U.S. PATENT DOCUMENTS

| | | | | |
|---|---|---|---|---|
| 7,350,467 | B2 | 4/2008 | Green et al. | |
| 7,591,621 | B1 * | 9/2009 | Landrum | B60P 3/40 410/44 |
| 7,895,950 | B2 | 3/2011 | Green et al. | |
| 8,181,577 | B2 | 5/2012 | Bounds | |
| 8,607,712 | B2 | 12/2013 | Herzog et al. | |
| 8,904,942 | B2 | 12/2014 | Herzong et al. | |
| 9,382,669 | B2 | 7/2016 | Herzog et al. | |
| 9,382,670 | B2 | 7/2016 | Herzong et al. | |
| 2006/0102042 | A1 | 5/2006 | Green et al. | |
| 2011/0041721 | A1 | 2/2011 | Bounds | |
| 2011/0129314 | A1 * | 6/2011 | Bounds | E01B 29/16 410/44 |
| 2014/0251174 | A1 | 9/2014 | Herzong et al. | |

* cited by examiner

LONG RAIL TRANSPORT TRAIN

RELATED APPLICATIONS

None.

BACKGROUND OF THE INVENTION

Field of the Invention

The present invention relates to the transportation of a long railroad rail sections used in continuously welded rail installation applications. More particularly, the present disclosure relates to a consist of railcars and fixtures adapted for top loading and end unloading of long rail sections.

Description of the Related Art

Modern railway construction, including new construction and replacement construction, is accomplished using long rail sections, sometimes referred to as ribbon-rail, which are commonly 1600 feet in length, and which are butt-welded together in the field into a continuously welded rail system. Steel fabrication mills do not produce rail in such great lengths, therefore multiple shorter sections of rail are welded together into 1600-foot sections, and these are referred to as continuously welded rail (CWR) sections. It is known that steel mills roll rail from ingots of steel, and these rails come out of the mill in 320 foot long lengths, which are usually cut to 80 foot lengths. Since CWR in the prior art are 1600 feet long, the rail produced by the mills is shipped to a processing facility where they are butt-welded together, and 'threaded' onto a special 1600-foot long train that transports them to a job site. Long sections of CWR are preferred because they reduced the number of butt-welded connection that crews in the field have to make while the track is being laid.

Multiple 1600-foot CWR sections are loaded onto a train and transported to a construction site, where they are pulled off the end of the train as the railway is constructed. Considering the process of loading 1600-foot CWR sections onto a 1600-foot long train, it will be appreciated that a facility having a length of at least 3200-feet is required. These long trains can not be routed under traditional manifest rail service, but rather require special train service, which is more expensive and has more limited train routing options available to it. It should also be noted that the technology of field-welding rail together has improved to where it is reasonable to make more field welds, which are both reliable and cost effective. Thus, it can be appreciated that there is a need in the art to reduce cost and improve efficiency of handling, transporting, and laying track using CWR technology.

SUMMARY OF THE INVENTION

The need in the art is addressed by the apparatus and methods of the present invention. The present disclosure teaches a consist of flatcars for transporting continuous rail sections that are greater in length than a single flatcar, and which is adapted for top loading and end unloading of the rail sections. The consist consists of a tie-down flatcar and plural support flatcars. The tie-down flatcar has a rail securement rack fixed to it. The securement rack includes a support frame, which is vertically oriented and fixed to the tie-down flatcar, and a rail sill fixed at the bottom of the support frame, for supporting plural rail sections on its upper surface. The securement rack further includes plural rail clamping shelves that can be selectively engaged with the support frame in a stacked manner above the rail sill. Each of the plural rail clamping shelves includes an upper surface for supporting plural rail sections, and a rail clamp assembly attached to the rail shelf for clamping to plural rail sections. The securement rack further includes a cap rail clamp configured the same as the rail clamping shelves, but omitting an upper surface for supporting plural rail sections. The plural support flatcars each include a roller support rack. The roller support racks each include a first rack support and a second rack support, both vertically oriented, which are fixed to the support flatcar, and a roller sill located between the first rack support and the second rack support on the flatcar deck, which has plural rollers disposed on its upper surface to support plural rail sections. The roller support rack further includes plural roller shelves arranged in a vertical stack and pivotally supported from the first rack support about a vertical axis, where each pivots between an open position that enables loading of rail sections from above, and a closed position where a distal end of each roller shelf engages the second rack support. Each roller shelf further includes plural rollers on their upper surface to engage and support plural rail sections, which enables longitudinal movement of the plural rail sections, and, a fastener at the distal end that fastens to the second rack support. The plural roller shelves open position is for loading and provides clearance for placement of the rail sections from above the consist, and the closed position for transport, where the shelves are generally orthogonal to the rail sections, to facilitate support thereof during transit and end unloading of the consist.

The present disclosure also teaches a consist of flatcars for transporting continuous rail sections that are greater in length than a single flatcar, which is configured for top loading and end unloading of the rail sections. The consist include a tie-down flatcar and plural support flatcars. The tie-down flatcar includes a rail securement rack fixed to it. The rail securement rack includes a support frame with plural rail clamping shelves supported from it, where the rail clamping shelves are removable from the support frame to enable placement of the rail sections from above the consist when removed, and to support rail section when installed in a position generally orthogonal to the rail sections. The rail clamping shelves include plural rail clamps positioned to engage and retain the rail sections in place during transit of the consist. The plural support flatcars are coupled to the tie-down flatcar. Each of the plural support flatcars has a roller rack fixed to it. The roller racks include plural roller shelves that each have plural rollers on top to engage and support the rail sections in a manner that enables longitudinal movement. The plural roller shelves are pivotally mounted to the roller racks between a loading position that provides clearance for placement of the rail sections from above the consist, and a transport position that is generally orthogonal to the rail sections to facilitate support thereof during transit and unloading of the consist.

In a refinement to the foregoing consist embodiment, where the rail sections are approximately 320-feet in length, the tie-down flatcar has two rail securement rack fixed to it, and, the plural support flatcars comprise two support flatcars, both coupled to the tie-down flatcar, and two end flatcars. The support flatcars each have two of the roller racks fixed to them. The two end flatcars each have a roller rack fixed to them, and each have a longitudinal barrier fixed adjacent to an unconnected end of the car. The longitudinal barriers have a door therein that opens to enable the rail sections to be drawn off an end of the consist of flatcars.

The present disclosure teaches a method of transporting continuous rail sections that are greater in length than a single flatcar, utilizing a consist of plural rail flatcars, which includes a tie-down flatcar and plural support flatcars. The tie-down flatcar has a rail securement rack fixed to it. The rail securement rack has a support frame for supporting a stack of plural rail clamping shelves that each include plural rail clamps. The plural support flatcars each have a roller rack fixed to them. The roller racks include a stack of plural roller shelves pivotally coupled thereto that each include plural rollers to engage and support the rail sections to enable longitudinal movement of the rail sections. The method includes the steps of removing the rail clamping shelves from the support frame, and pivoting open the stacks of roller support shelves to a loading position that provides clearance for placement of rail sections from above. Then, setting, from above the consist, plural rail sections on the rail securement rack and the roller racks of the plural support flatcars. Next, replacing a rail clamping shelf to the stack of plural rail clamping shelves, and closing a roller shelf in the stack of plural roller shelves by pivoting to a position orthogonal to the rail sections, thereby enabling the support of another layer of rail sections. Then, repeating the setting, replacing, and closing steps until the stack of plural rail clamping shelves have been set and until the stack of plural roller shelves have been closed. Once complete, clamping the rail sections to the rail securement rack by engaging the plural rail clamps with the plural rail sections, and transporting the consist to a destination. At destination, unclamping the rails sections from the rail securement rack by disengaging the plural rail clamps from the plural rail sections, and pulling the plural rail sections from an end of the consist.

The present disclosure teaches a rail securement rack for a tie down flatcar useful in a consist of flatcars for transporting plural continuous rail sections. The rail securement rack includes a support frame, vertically oriented that is fixed to the tie-down flatcar. A rail sill is fixed adjacent a lower portion of the support frame, for supporting plural rail sections on its upper surface. Plural rail clamping shelves are configured to selectively engage the support frame in a stacked manner above the rail sill. Each of the plural rail clamping shelves further includes a rail shelf having an upper surface for supporting plural rail sections and a rail clamp assembly attached to the rail shelf that retainably engages plural rail sections therebelow. Each of the rail clamp assembly further includes a clamp carriage that has a ramp surface, with plural rail clamps attached to a lower portion thereof that engage the plural rail sections, and a ramp drive assembly, located between the rail shelf and the clamp carriage, which includes a ramp drive actuator and a ramp driver arranged to engage the ramp surface such that actuation of the ramp drive actuator urges the plural rail clamps to retainably engage the plural rail sections. The rail securement rack also includes a cap rail clamp this is configured the same as the rail clamp assembly, but omitting an upper surface for supporting plural rail sections.

In a refinement, the foregoing rail securement rack further includes plural rail flange spacers disposed upon the upper surface of the rail sill and disposed upon an upper surface of each of the rail shelves, to thereby separate the plural rails sections supported thereon.

In a refinement, the foregoing rail securement rack further includes plural twistlock fastener disposed between each of the plural rail clamping shelves and the support frame, enabling selective engagement therebetween.

In a refinement to the foregoing rail securement rack, the clamp carriage includes two ramp surfaces that are opposingly aligned with one another, and the ramp drive assembly includes two ramp drivers that correspondingly engage the two ramp surfaces.

In a refinement to the foregoing rail securement rack, the clamp carriage further includes plural clamp bosses extending therefrom to support the plural rail clamps, which accommodates the height of the rail sections such that the plural rail clamps engage the feet of the rail sections.

In a refinement, the foregoing rail securement rack further includes a ramp drive actuator lock disposed between the rail clamping shelf and the ramp drive actuator, which enables selective locking of the ramp drive actuation against movement of the ramp driver.

In a refinement to the foregoing rail securement rack, the support frame includes two side supports and one center support, which are all vertically oriented, and, the plural rail clamping shelves that are disposed between the center support and one of the two side supports.

The present disclosure teaches a roller support rack for a support flatcar that is useful in a consist of flatcars for transporting plural continuous rail sections. The roller support rack includes a first rack support and a second rack support, both vertically oriented, that are fixed to the support flatcar. A roller sill is disposed between the first rack support and the second rack support, and adjacent the support flatcar deck, and has plural rollers disposed on an upper surface thereof for supporting plural rail sections. Plural roller shelves are arranged in a vertical stack and are pivotally supported from the first rack support about a vertical axis. Each roller shelf is pivotable between an open position that enables loading of rail sections from above, and a closed position where a distal end of each roller shelf engages the second rack support. Each of the roller shelves further includes plural rollers position about an upper surface thereof to engage and support plural rail sections thereupon, and thereby enable longitudinal movement of the plural rail sections supported thereby, and each includes a fastening means disposed at the distal end, that fastens to the second rack support.

In a refinement to the foregoing roller support rack, the fastening means is a twistlock fasteners disposed between the distal end of the plural roller shelves and the second rack support.

In a refinement to the foregoing roller support rack, the plural roller shelves further include plural rail flange spacers disposed upon the upper surface, to thereby separate the plural rails sections supported thereon.

In a refinement, the foregoing roller support rack further includes a third rack support located on an opposite side of the second rack support from the first rack support, and, the plural roller shelves are disposed in two vertical stacks, one pivotally coupled to the first rack support, and the other pivotally coupled to the third rack support, and both having fastening means that engaged the second rack support.

DESCRIPTION OF THE INVENTION

Figure 2:
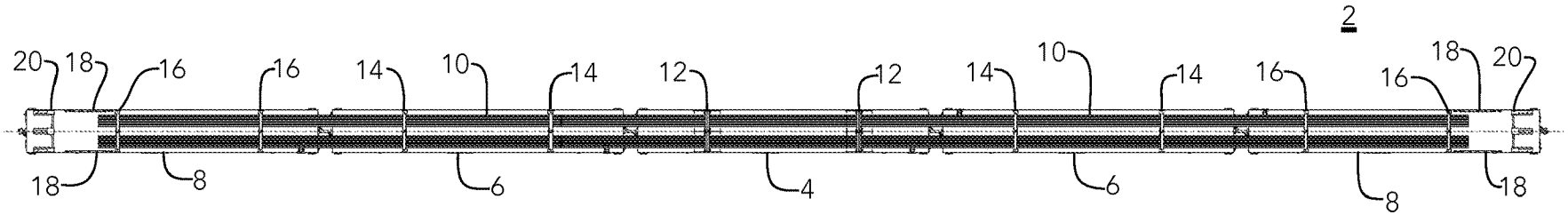
FIG. 2 is a top view drawing of a consists for transporting continuous rail section according to an illustrative embodiment of the present invention.

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope hereof and additional fields in which the present invention would be of significant utility.

In considering the detailed embodiments of the present invention, it will be observed that the present invention resides primarily in combinations of steps to accomplish various methods or components to form various apparatus and systems. Accordingly, the apparatus and system components, and method steps, have been represented where appropriate by conventional symbols in the drawings, showing only those specific details that are pertinent to understanding the present invention so as not to obscure the disclosure with details that will be readily apparent to those of ordinary skill in the art having the benefit of the disclosures contained herein.

In this disclosure, relational terms such as first and second, top and bottom, upper and lower, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a" does not, without more constraints, preclude the existence of additional identical elements in the process, method, article, or apparatus that comprises the element.

The present disclosure teaches a long rail transport train with fixtures and methods of using them. The rail train is configured to carry 320 foot or 480 foot long sections of rail using five or seven conventional 68-foot flatcars, which may be coupled with drawbars into a consist of flatcars that travel as a unit. In such an arrangement, the railcars are connected by solid drawbars and are not separable during transport. It should be noted that other rail lengths and car combinations are contemplated under the teachings of the present disclosure. In an illustrative embodiment, the flatcars each comprise at least two rail support structures spaced approximately 34-feet apart. Most of these are roller support racks that each have an array of rail support positions along which the rails are allowed to slide as they are carried by roller bearings. At each end of the train is an end rack, which is characterized as having an end stop to prevent longitudinal movement of the rails from sliding off the train, but also enabling longitudinal 'play' to accommodate relative movement of the rail ends as the train traverses curves and hills. The end rack also prevents excessive lateral movement of the rail ends, to keep them within a predetermined railway clearance profile. The center flatcar has at least one rail securement rack that fixedly locates the rails by gripping them with a clamp, which is manually engaged and disengaged.

In an illustrative embodiment of the present disclosure, a five flatcar train is coupled with drawbars into a unit, referred to as a "consist" in railroad parlance, that is used to transport 320 foot sections of rail from a rail manufacturing mill directly to a job site for installation, thereby obviating the need for a separate rail welding and long train loading facility. The rails are loaded onto the train at the point of manufacture, by setting them from above using crane machines, and not by threading rails through the end of the train. Novel clamping and roller support mechanisms are provided to hold the rails on the consist and to facilitate their support and unloading. The technology of field-welding rail together has improved to where it is reasonable to weld 320-foot sections in the field, rather than requiring longer 1600-foot sections welded together at a separate facility. With the shorter trains, it becomes possible to lift the 320-foot sections of rail and set them on a five-flatcar consist, rather than having to thread them on through the end of the train, which requires at least 3200-feet of space to do. Also, the 1600-foot trains fall into the "Special Train Service" classification, which is more expensive and more limited in terms of routing options to the job sites. The five flatcar, 320-foot, consists can be handled using regular "Manifest Service" and this offers lower cost and more flexible routing in delivery to job sites and return of the consist for reuse.

By application of the teachings of the present disclosure, a number of operational benefits are realized. The top loading consist meets AAR (Association of American Railroads) open top loading requirements. In transport, for railroad purposes, this equipment is treated as one long railcar similar to an articulated intermodal car having a single car number. The present disclosure rail transport approach eliminates intermediary movement to rail welding plants for joining rails into 1600-foot segments. All of the fixtures, cars, and load fit within AAR clearance plate specifications. The train/consist will move in manifest (i.e. non-unit train) service when both empty and loaded with rail sections, and when the consist is waybilled, it will contain a destination and follow standard manifest network trip plan to that destination.

Figure 1:
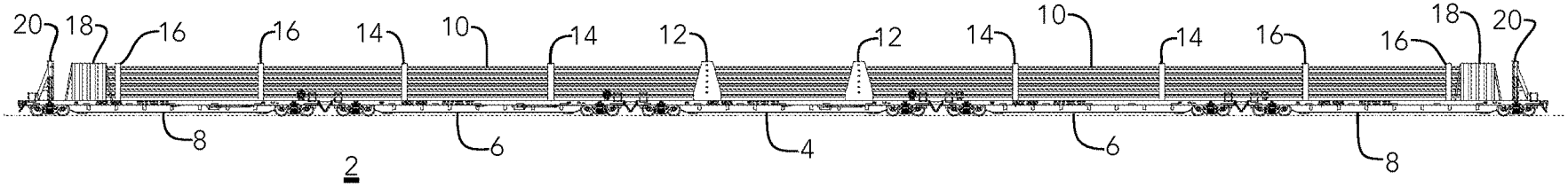
FIG. 1 is a side view drawing of a consists for transporting continuous rail section according to an illustrative embodiment of the present invention.

Reference is directed to FIG. 1 and FIG. 2, which are side view and top view drawings, respectively, of a five flatcar consists 2 for transporting continuous rail sections 10 according to an illustrative embodiment of the present invention. A tie down car flatcar 4 is positioned near the center of the consist 2, and is characterized as having at least one rail securement rack 12 fixed to its deck. In this embodiment, there are two rail securement racks 12. The primary purpose of a rail securement rack is to clamp the rails 10 at fixed positions relative to the flatcar 4, particularly along the longitudinal axis of the consist 2. The consist 2 further includes plural roller support flatcars 6, which are characterized as having roller support racks 14, which support the rails 10, but enable longitudinal movement of the rails 10 by virtue of roller bearing support. The roller racks 14 facilitate end unloading of the rails and also accommodate longitudinal movement between the cars during transport, and thermal expansion of the rails 10 themselves. An end car 8 is positioned at both ends of the consist 2. The end cars 8 are characterized as having a longitudinal barrier 20 and a pair of lateral barriers 18. The end cars 8 may also include one or more roller support racks 16. The pair of lateral barriers 18 are a pair vertical barriers fixed to the end car deck along the sides of the end car 8, adjacent to the unconnected end of the end car 8, which prevent movement of the rails 10 from extending off the side of the end car 8 in either lateral direction, and prevents the ends of the rails 10 from swinging wide in turns, possibly exceeding railroad lateral clearance regulations. The longitudinal barriers 20 prevent any rail 10 sliding off the consist 2, which might occur should the rail securement racks 12 fail to retain the rails 10. The longitudinal barriers 20 are vertical barrier positioned at the unconnected end of the end cars 8 to prevent the rails 10 from sliding off the end of the end car 8, and have a pair of doors supported on vertical hinges the enable the doors to swing between a closed position where the rails 10 are retained on the consist 2, and an open positions where the rails 10 may be drawn off either end of the consist 2 at the time they are unloaded at a job site.

Figure 4:
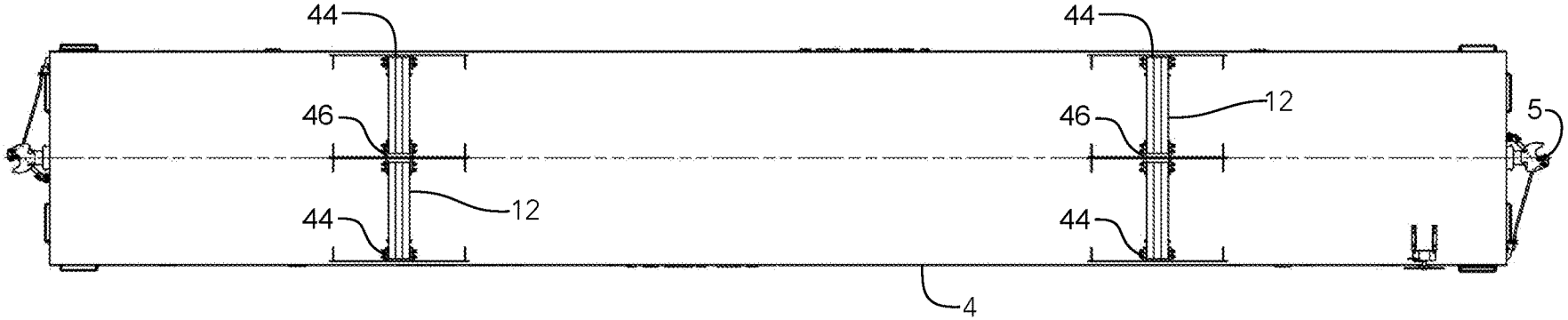
FIG. 4 is a top view drawing of a tie-down flatcar useful in a consist for transporting continuous rail section according to an illustrative embodiment of the present invention.
Figure 3:
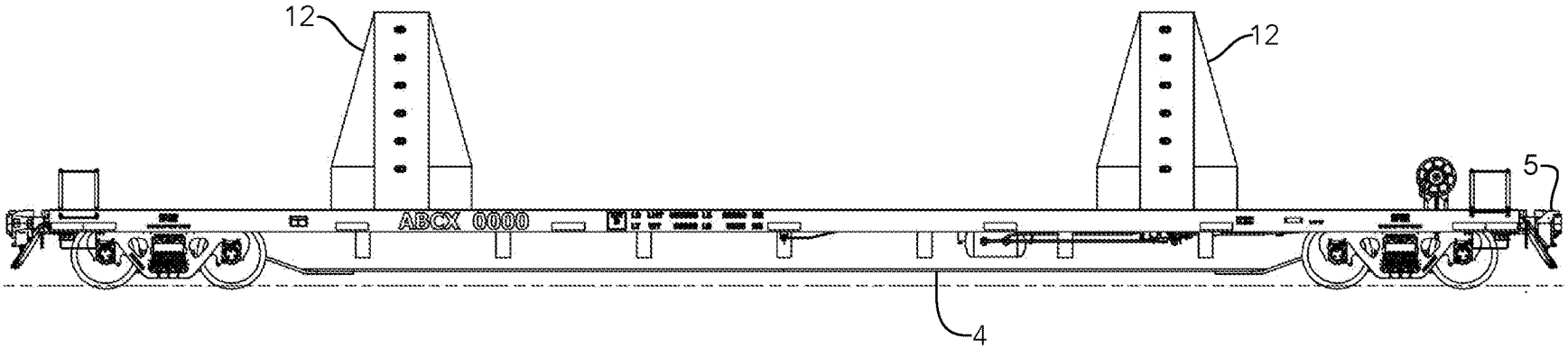
FIG. 3 is a side view drawing of a tie-down flatcar useful in a consist for transporting continuous rail section according to an illustrative embodiment of the present invention.

Reference is directed to FIG. 3 and FIG. 4, which are side view and top view drawings, respectively, of a tie-down flatcar 4 useful in a consist for transporting continuous rail sections according to an illustrative embodiment of the present invention. The flatcar 4 is illustrated as a conventional 68-foot flatcar with conventional couplers 5. However, other lengths and types of railcars could be employed under the teachings of the present invention. Further, other embodiments employ drawbars in place of the conventional couplers 5 for assembly of plural flatcars into a unitized consist. The tie down flatcar 4 is characterized as having at least one rail securement rack 12, however, this embodiment employs a pair of rail securement racks 12. The rail securement racks 12 include a center support 46 and a pair of side supports 44, which are fixedly secured to the flatcar 4. The rail securement racks employ drop-down rail clamping shelves with a bottom sill shelf and rack support channels permanently fixed to the railcar deck. The middle and top shelves are loaded into rack support channels from above, via crane. The rail clamping shelves are connected, one above the other, using twistlock fasteners, and the top shelf is bolted to rack support channels. These features will be more fully discussed hereinafter.

Figure 6:
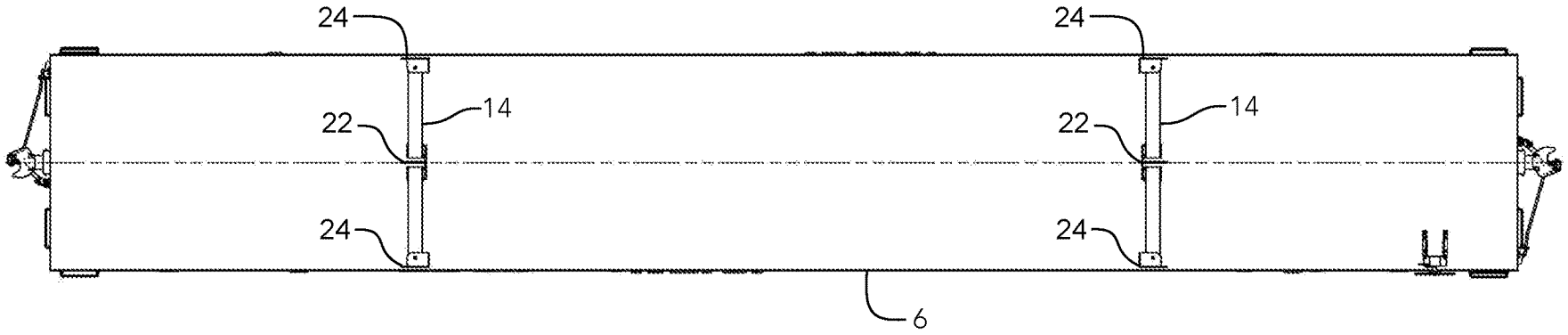
FIG. 6 is a top view drawing of a roller support flatcar useful in a consist for transporting continuous rail section according to an illustrative embodiment of the present invention.
Figure 5:
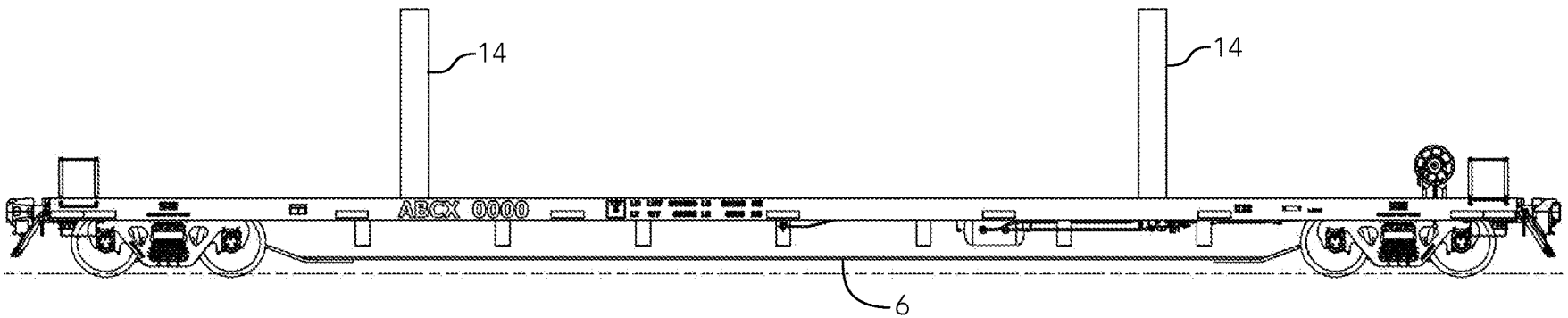
FIG. 5 is a side view drawing of a roller support flatcar useful in a consist for transporting continuous rail section according to an illustrative embodiment of the present invention.

Reference is directed to FIG. 5 and FIG. 6, which are side view and top view drawings, respectively, of a roller support flatcar 6 useful in a consist for transporting continuous rail sections according to an illustrative embodiment of the present invention. The flatcar 6 is illustrated as a conventional 68-foot flatcar. However, other lengths and types of railcars could be employed under the teachings of the present invention. The roller support flatcar 6 is characterized as having at least one roller support rack 14, however, this embodiment employs a pair of roller support racks 14. The roller support racks 14 include a center support 22 and a pair of side supports 24, which are fixedly secured to the flatcar 6.

Figure 8:
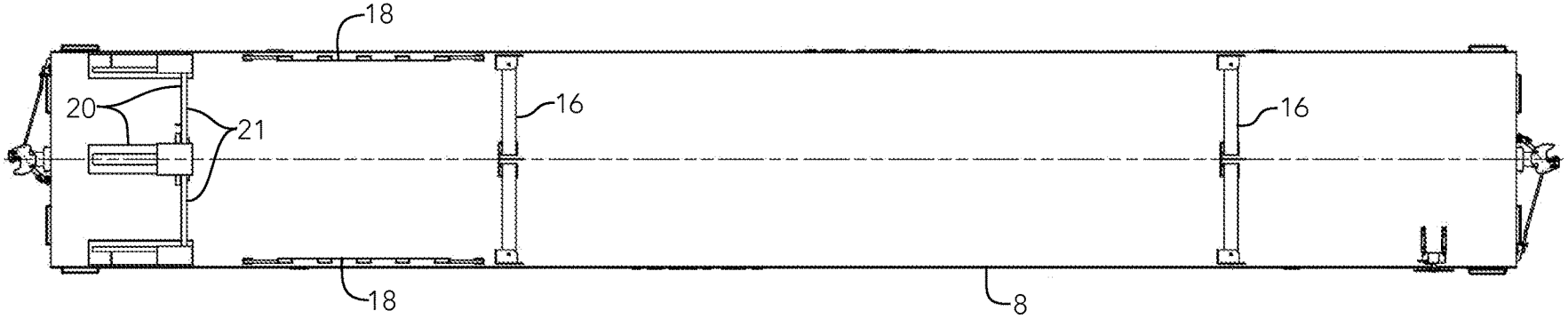
FIG. 8 is a top view drawing of an end flatcar useful in a consist for transporting continuous rail section according to an illustrative embodiment of the present invention.
Figure 7:
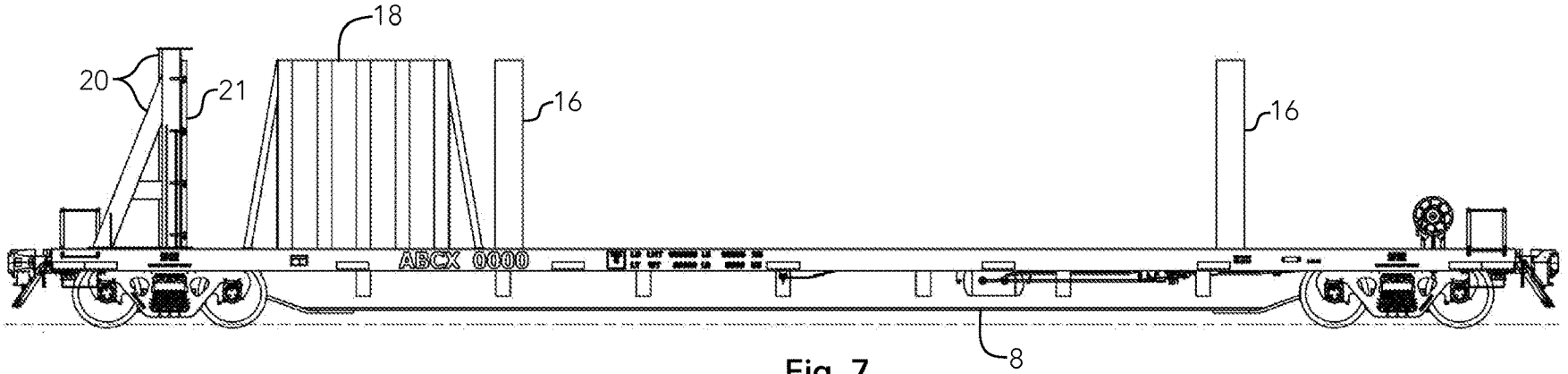
FIG. 7 is a side view drawing of an end flatcar useful in a consist for transporting continuous rail section according to an illustrative embodiment of the present invention.

Reference is directed to FIG. 7 and FIG. 8, which are side view and top view drawings, respectively, of an end flatcar 8 useful in a consist for transporting continuous rail sections according to an illustrative embodiment of the present invention. The flatcar 8 is illustrated as a conventional 68-foot flatcar. However, other lengths and types of railcars could be employed under the teachings of the present invention. The end flatcar 8 is characterized as having a pair of lateral barriers 18 along opposing side of the flatcar 8, which serve to limit lateral movement of the rail ends (not shown) as the consist rounds tight radius curves. These barriers 18 are sized and positioned according to the rail loading arrangement of the particular consist parameters, and are fabricated from conventional mild steel structural sections and plate. The end car 8 is further characterized has having a longitudinal barrier 20 adjacent one end of the flatcar 8. The longitudinal barrier 20 includes a pair of doors 21, which are illustrated in the closed position, but also swing to an open position (not shown). In the closed position, the doors limit the longitudinal range of movement possible for the rails (not shown). This is a security and safety feature of the system, as the primary control of longitudinal movement of the rails is provided by the rail securement racks, discussed in further detail herein. When the doors 21 are opened, the rail sections (not shown) may be removed by pulling or pushing them off the end of the consist. The end car 8 may also comprise one or more roller support racks 16, as may be required to properly support the rail sections (not shown). These roller support racks 16 are essentially the same as roller support racks 14 discussed herein.

Figure 9:
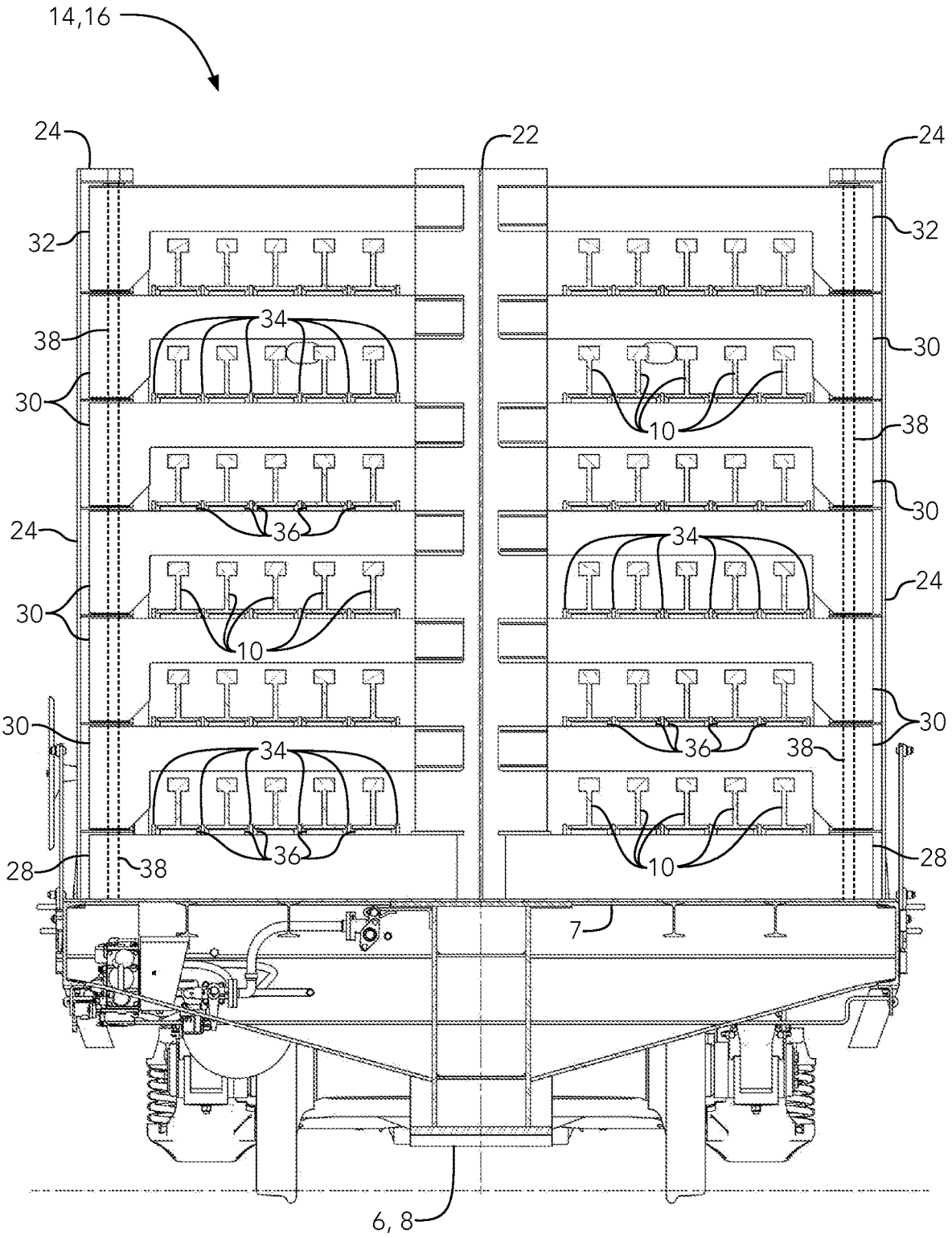
FIG. 9 is an end view drawing of a flatcar with a roller support rack fixed thereto, for continuous rail sections according to an illustrative embodiment of the present invention.

Reference is directed to FIG. 9, which is an end view drawing of a flatcar 6,8 with a roller support rack 14,16 fixed thereto, for continuous rail sections 10 according to an illustrative embodiment of the present invention. The roller support rack, or "roller rack," 14,16 comprises vertical supports 22 and 24 that are fixed to the flatcar 6,8 by welding or other serviceable structural connection. In this embodiment, there is one center vertical support 22 and two side vertical supports 24. In other embodiments, just two vertical supports may be employed. A pair of roller sills 28 are also fixed to the flatcar 6,8, and present plural roller bearings 36 for supporting plural sections of rail 10 thereon. The pair of roller sills 28 also present rail spacers 34 on their upper surface, which are steel bars or plate that separate the feet of adjacent rail sections 10, also referred as the rail flanges. This arrangement prevents one rail section from dragging an adjacent rail sections along with it as it is pulled from the consist, and also serves to precisely located the rail sections along the lateral direction.

The roller rack 14,16 in FIG. 9 includes hinge pins 38 disposed in a vertical direction and fixed to the side vertical supports 24. Plural roller shelves 30 are stacked vertically and pivotally coupled to the side vertical supports 24 such that the roller shelves 30 can rotate through approximately ninety degrees from being aligned along a lateral axis of the flatcar 6,8 (as illustrated) to being aligned along a longitudinal axis the flatcar 6,8. In this manner the upper roller racks 30 can be swung out of the way to load rail sections 10 on the lower roller shelves 30. Also, a pair of caps 32 are pivotally coupled to the hinge pins 38, which serve to cover and retain the rail sections 10 on the upper most roller shelves 30. Also note that the several roller shelves 30 include rail spacers 34 on their upper surfaces, which are steel bars or plate that separate the feet of adjacent rail sections 10.

Figure 10:
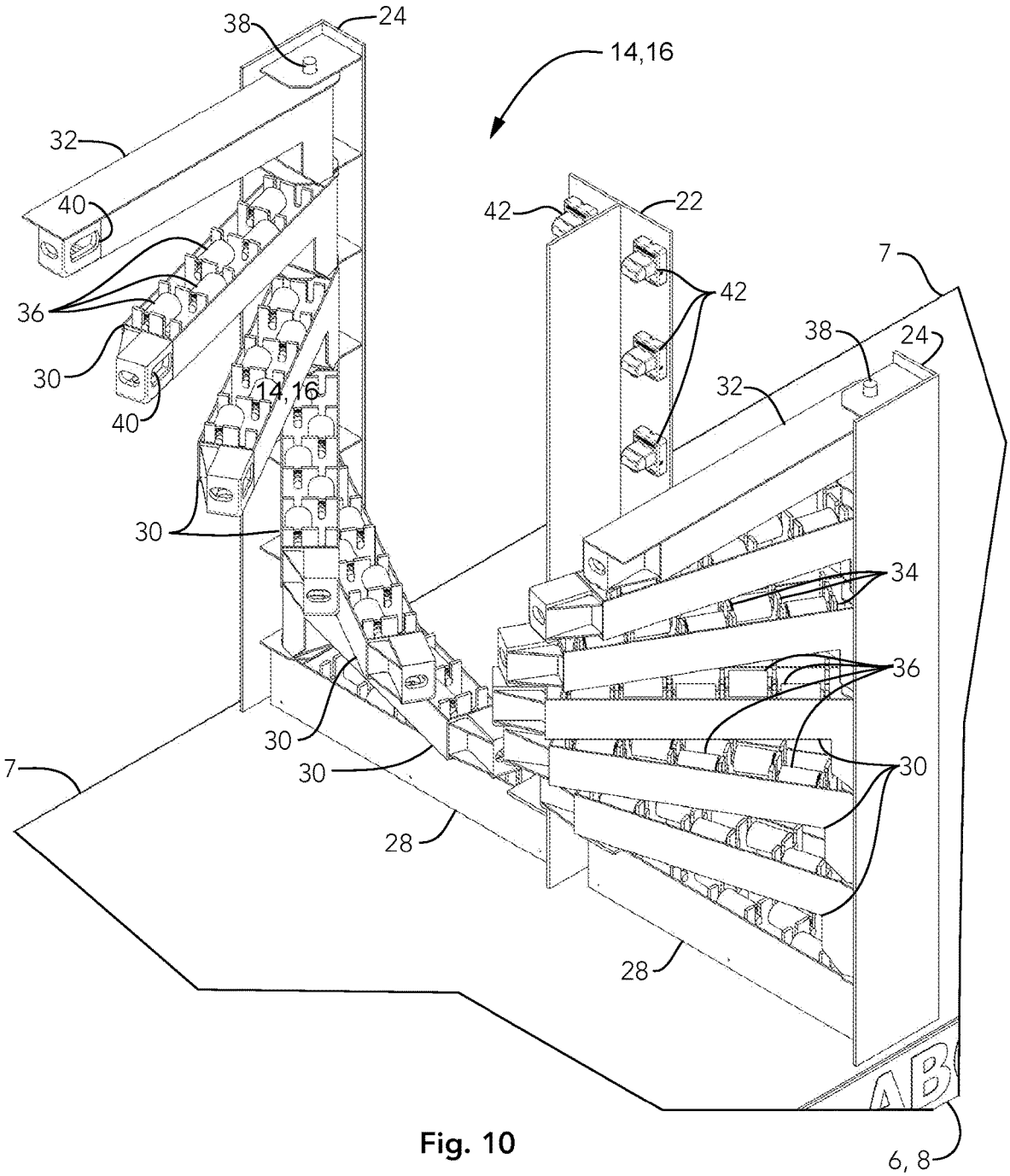
FIG. 10 is an isometric view of a roller support rack for continuous rail sections according to an illustrative embodiment of the present invention.

Reference is directed to FIG. 10, which is an isometric view of a roller support rack 14,16 for continuous rail sections according to an illustrative embodiment of the present invention. This view omits the rail sections illustrated in FIG. 9, rather showing the pivoting movement of the roller shelves 30 and caps 32. In FIG. 10, the flatcar 6,8 is partially shown, including a portion of its deck 7 surface to which the one center vertical support 22 and two side vertical supports 24 are welded. In addition, the pair of roller sills 28 are also fixed to the flatcar 6,8, deck surface 7. The tops of the hinge pins 38 disposed in a vertical direction and fixed to the side vertical supports 24 can be seen in this view. The plural roller shelves 30 are stacked vertically and pivotally coupled to the side vertical supports 24 such that the roller shelves 30 can rotate through approximately ninety degrees as illustrated. In this manner the upper roller racks 30 can be swung out of the way to load rail sections (not shown) on the lower roller shelves 30. Also, the pair of caps 32 are pivotally coupled to the hinge pins 38. Each roller shelf 30 comprises plural roller bearings 36 on the upper surface for supporting rail sections (not shown), and oriented such that the rail sections can be drawn off the consist (not shown) from either end of the consist. Each roller shelf 30 also includes plural rail spacers 34 disposed between the plural rollers 36. On the distal end of each roller shelf 30 and the caps 32 is located a twistlock socket 40. On the center support 22 is located plural twistlock fasteners 42 that correspond to the plural twist lock sockets 40 such that the roller shelves 30 and caps 32 can be locked in the closed position adjacent the center support 22, and aligned laterally during transport. Twistlock fastener systems are well known to those in the container, intermodal, and shipping arts.

Figure 11:
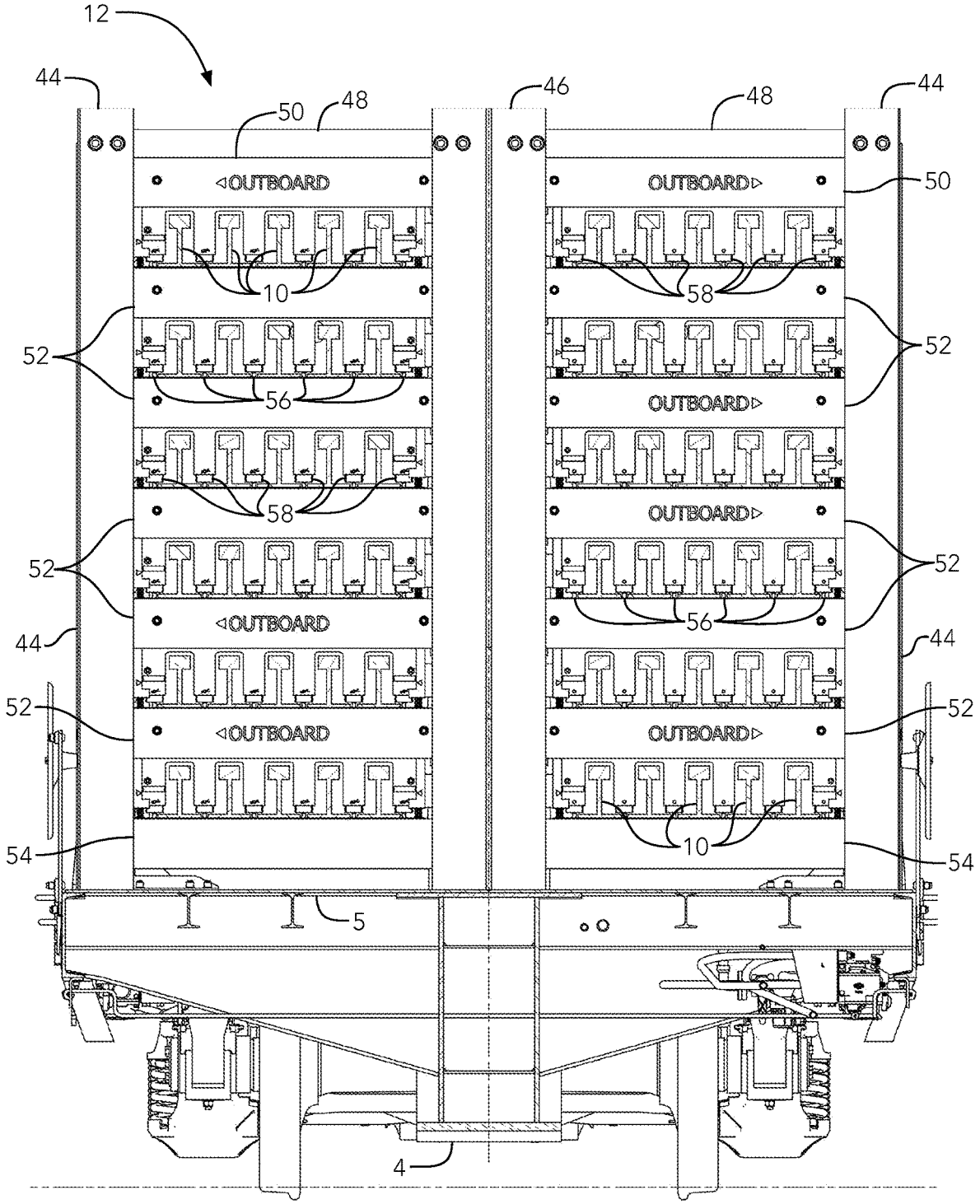
FIG. 11 is an end view drawing of a flatcar with a rail securement rack fixed thereto, for continuous rail sections according to an illustrative embodiment of the present invention.

Reference is directed to FIG. 11, which is an end view drawing of a tie down flatcar 4 with a rail securement rack 12 fixed thereto, for continuous rail sections 10 according to an illustrative embodiment of the present invention. The function of the rail securement rack 12 is to fix the position of the plural rails 10 with respect to the flatcar 4 specifically, and the consist (not shown) generally. In this embodiment, the rail securement rack secures six layers of ten rails, five on each side, for a total of sixty 320-foot long rail sections. The securement action is accomplished in the illustrative embodiment by urging clamping pressure of plural rail clamps 58 against the plural rails 10, particularly urging against the feet, or base flanges, of those rails 10. The structure of the rail securement rack 12 includes a pair of structural side supports 44, which are fixed to the flatcar by welding or other suitable structural connection, and a center support 46, also fixed to the flatcar 4 by structural connection. A pair of rail sills 54 are disposed between the center 46 and side 44 supports to support the lowest layer of rails 10. Sequentially stacked thereabove are plural rail clamping shelves 52, with layers of rails 10 disposed therebetween, and at the top of the stack is a pair of rail cap clamps 50, which serve to urge clamping pressure against the top layer of rails 10. The side 44 and center 46 supports are further joined at their upper ends with a pair of structural members 48, such as C-channel, that are bolted in place after the rail securement rack 12 is loaded with rail sections 10. Each of the rail clamping shelves 52 and rail cap clamps 50 comprise rail clamps 58 that are urged against the rails 10 using an internal rail clamping mechanism, which will be more fully described hereinafter. Further, each of the rail sills 54 and rail clamp shelves 52 comprise rail spacers 56 on their upper surface, which are steel bars or plate that separate the feet of adjacent rail sections 10. This arrangement prevents one rail section 10 from dragging adjacent rail sections along with it as it is pulled from the consist, and also serves to precisely located the rail sections along the lateral direction of the rail securement rack 12.

Figure 13:
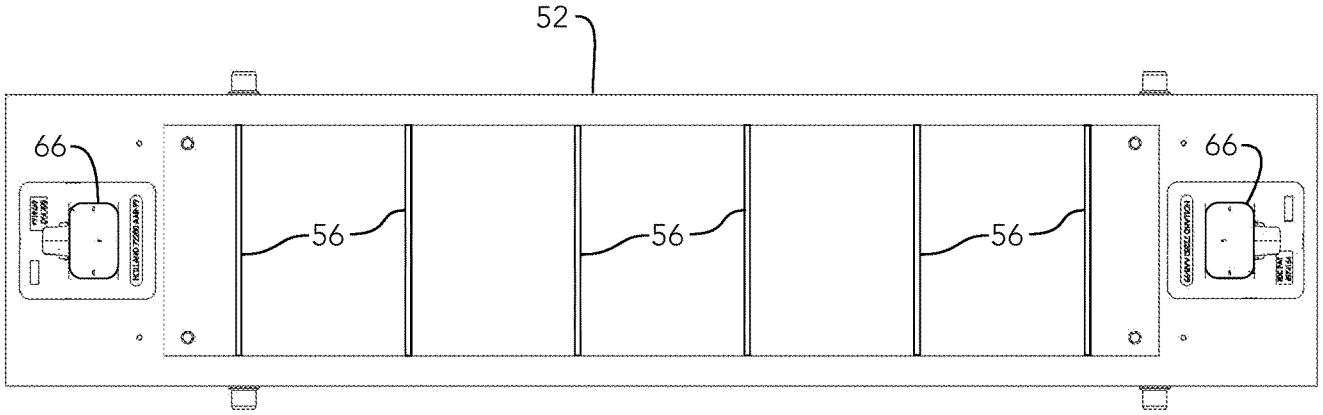
FIG. 13 is a top view drawing of a rail clamp shelf according to an illustrative embodiment of the present invention.
Figure 12:
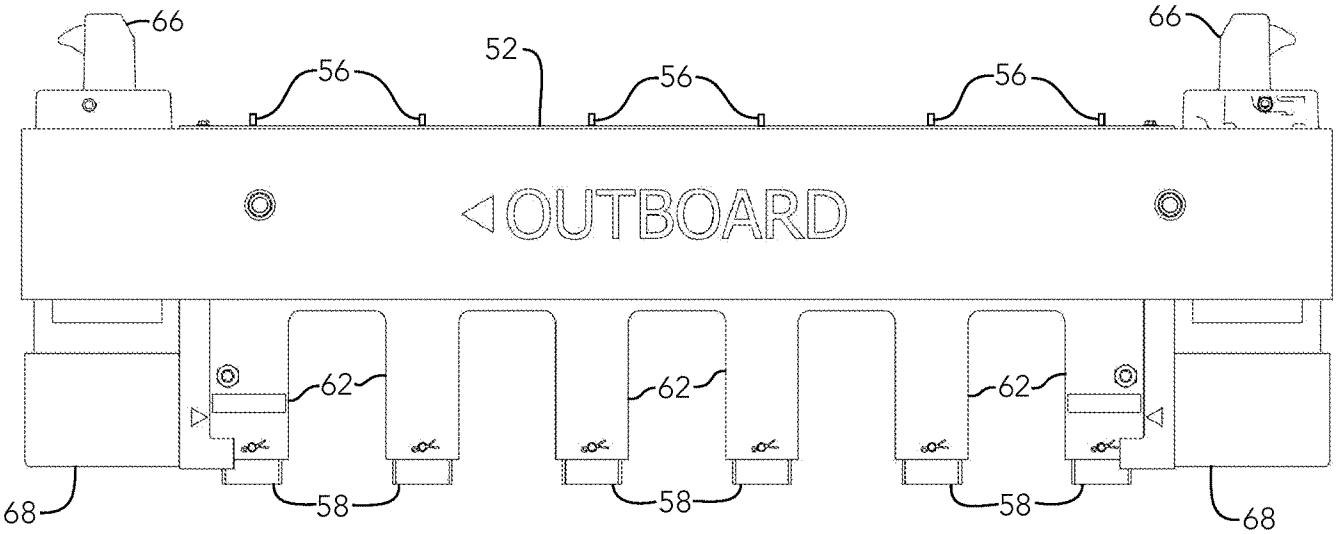
FIG. 12 is a side view drawing of a rail clamp shelf according to an illustrative embodiment of the present invention.
Figure 14:
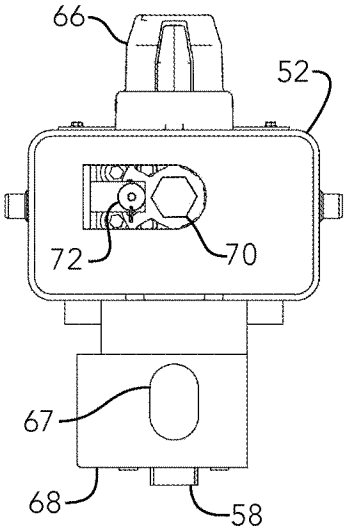
FIG. 14 is an end view drawing of a rail clamp shelf according to an illustrative embodiment of the present invention.

Reference is directed to FIGS. 12, 13, and 14, which are side view, top view, and end view drawings, respectively, of a rail clamp shelf 52 according to an illustrative embodiment of the present invention. At each of the two ends of the rail clamp shelf 52 are located a twist lock fastener 66 on the upper portion thereof and a twist lock corner casting 68 on a lower portion thereof, which presents twistlock sockets 67, as are known to those skilled in the art. With this arrangement, the rail clamp shelves 52 can be stacked one atop the other and fixedly joined using the twistlock fastening system 66, 68. Thus, the rail clamp shelves 52 can be completely removed from the rail securement rack (item 12 in FIG. 11) such that the rail sections (not shown) can be laid in place from above and then another rail clamp shelf 52 place on top, and so on in sequence until the rail securement rack is full, at which time the rail cap clamp (item 50 in FIG. 11) is attached at the top of the stack.

The rail clamp shelf 52 in FIGS. 12, 13, and 14 further include the aforementioned rail spacers 56 on their upper surface, which are steel bars or plate that separate the feet of adjacent rail sections (not shown). Extending downward from the rail clamp shelf 52 are plural clamp bosses 62 which extend and support the plural rail clamps 58 that are urged against the rail section feet, also referred to as base flanges (not shown). The clamp bosses 62 provide the extension needed to clear the rail section head and rail section web so that the rail clamps 58 can engage the rail section feet (not shown). At the outboard side of each rail clamp shelf, a clamp actuator 70 and actuator lock 72 are accessible for an operator to apply claiming force. A hex head bolt is presented as the clamp actuator 70, such that conventional wrenches, hex sockets, and impact wrenches can be utilized to apply clamping force. The internal mechanism of the rail clamping shelve 52 and rail cap clamp (item 50 in FIG. 11) will be more fully described hereinafter.

Figure 15:
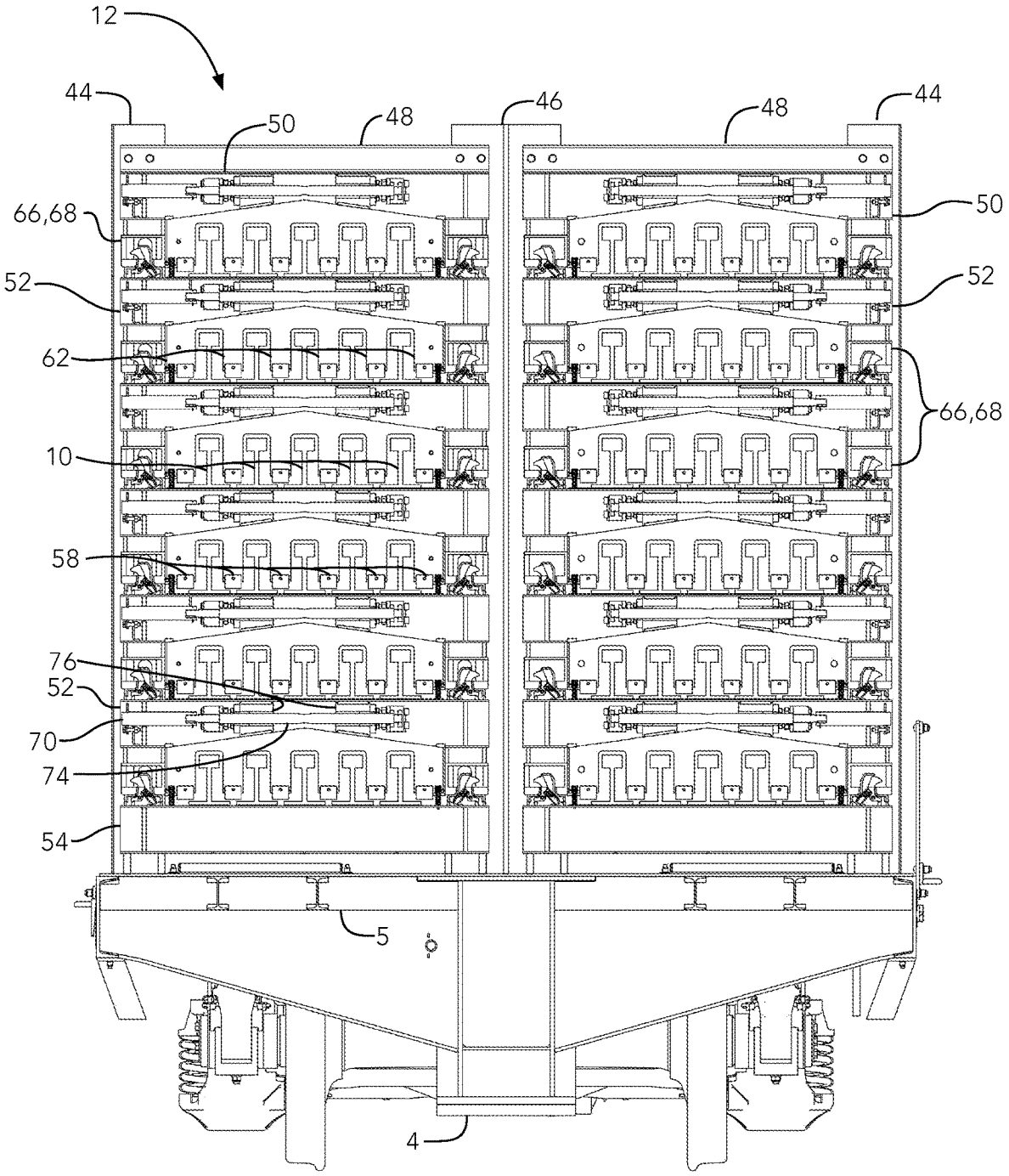
FIG. 15 is a section view drawing of a flatcar with a rail securement rack fixed thereto, for continuous rail sections according to an illustrative embodiment of the present invention.

Reference is directed to FIG. 15, which is a section view drawing of a tie down flatcar 4 with a rail securement rack 12 fixed thereto, for continuous rail sections 10 according to an illustrative embodiment of the present invention. This figure illustrates some of the internal components of the rail clamp shelves 52 and rail cap clamp 50, and how they interconnect with one another. Note that there are plural instances of rails sections 10 and rail clamp shelves 52, as well as the subcomponents, and that not every instance is identified with reference numerals. It is to be understood that like elements are identified with like reference numerals, even though the reference numerals don't appear for every instance of such elements in the drawing figures. The securement action is accomplished in the illustrative embodiment by urging clamping pressure of plural rail clamps 58 against the plural rails 10, particularly urging against the feet rails 10. The structure of the rail securement rack 12 includes a pair of structural side supports 44, which are fixed to the flatcar, and a center support 46, also fixed to the flatcar 4. A pair of rail sills 54 are disposed between the center 46 and side 44 supports to support the lowest layer of rails 10. Sequentially stacked thereabove are plural rail clamping shelves 52, with layers of rails 10 disposed therebetween, and at the top of the stack is a pair of rail cap clamps 50, which serve to urge clamping pressure against the top layer of rails 10. Each of these are connected using corresponding sets of twist lock fasteners 66 and twistlock corner castings 68, as are known to those skilled in the art. The side 44 and center 46 supports are further joined at their upper ends with a pair of structural members 48 that are bolted in place after the rail securement rack 12 is loaded with rail sections 10 in this embodiment. Each of the rail clamping shelves 52 and rail cap clamps 50 comprise rail clamps 58 that are urged against the rails 10 using an internal rail clamping mechanism, 70, 74, and 76, which will be more fully described hereinafter. The rail clamps 58 are support by clamp bosses 62 that extend downward from the rail clamp shelves 52.

Figure 16:
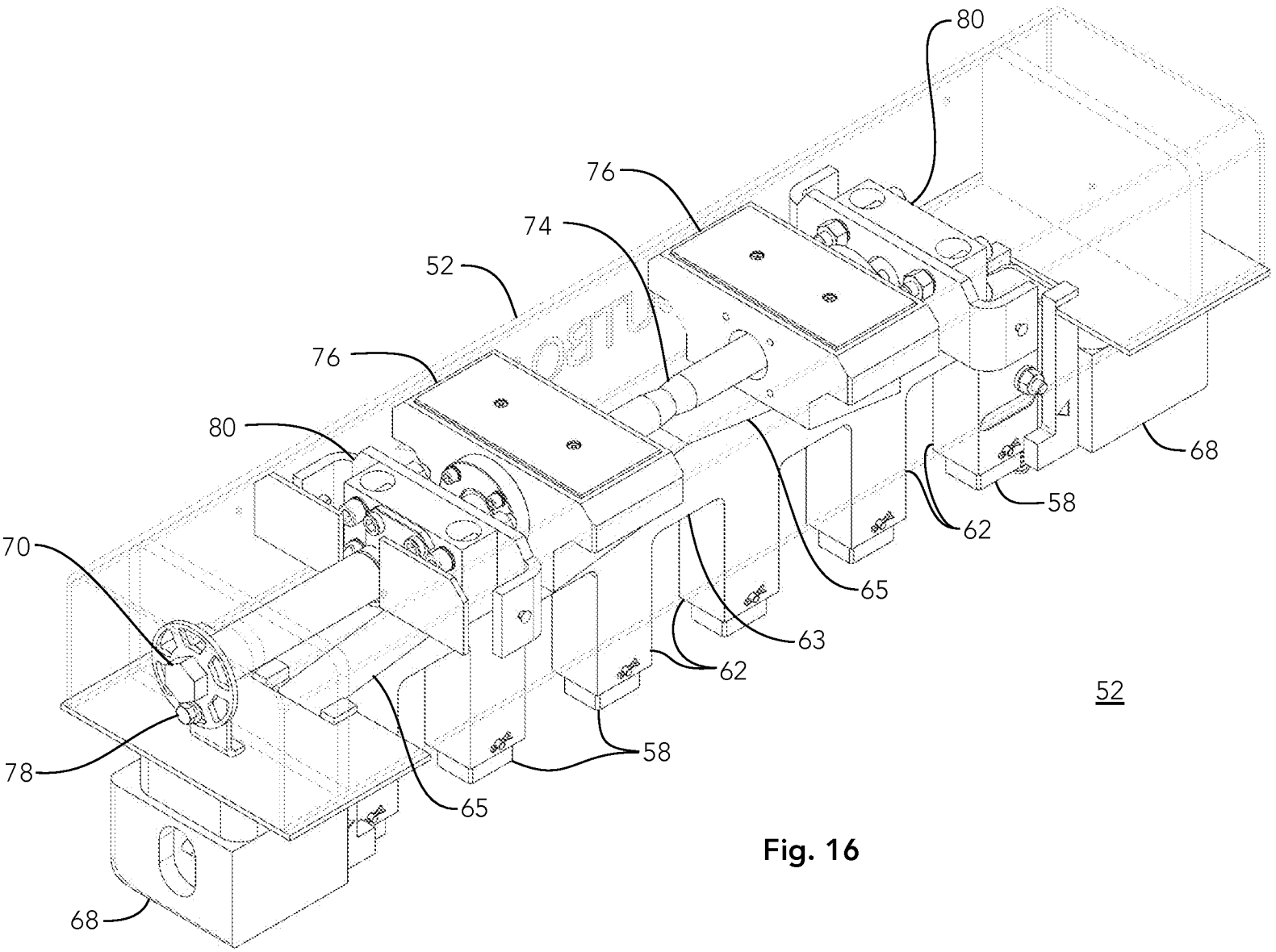
FIG. 16 is an isometric view drawing of a rail clamp shelf according to an illustrative embodiment of the present invention.

Reference is directed to FIG. 16, which is an isometric view drawing of a rail clamp shelf 52 according to an illustrative embodiment of the present invention. The internal structures depicted herein also apply to the rail cap clamp (item 50 in FIG. 11). Within rail clamp shelf 52 is a clamp carriage 63 that has at least one ramp surface 65 on its upper surface. In the illustrative embodiment, there are two opposing ramp surfaces 65 on the clamp carriage 63. The clamp carriage 63 has plural clamp bosses 62 extending downwardly therefrom, which each support a corresponding rail clamp 58. The length of the rail clamps 58 extension from the clamp bosses 62 may be adjusted using a pin and clip, if needed. The vertical position of the clamp carriage 63 is adjusted downwardly to apply clamping force against the rail sections (not shown) by engagement of a pair of ramp drivers 76 with corresponding ramp surfaces 65 on the clamp carriage 63 to urge the clamp carriage 63 downward as the ramp drivers 76 are urged up the ramp surfaces 65 by ramp driver actuator 74, which is a threaded rod in this embodiment. This is a classic inclined-plane manner of converting force. Of course, the converse movement will enable the clamp carriage 63 to move up and release the clamping forces on the rail sections (not shown). The ramp driver actuator 74 is threaded on its exterior surface to engage threads in the ramp drivers 76. The ramp driver actuator 74 is rotatably coupled to the rail clamp shelf 52 using a pair of suitable bearings 80. The outboard end of the ramp driver actuator 74 presents a hex extension for coupling to a suitable tool, such as an impact wrench and drive socket. The actuator lock 78 interferes with rotation of the ramp diver actuator 74, to thereby lock the ramp divers 76 in position.

Figure 17:
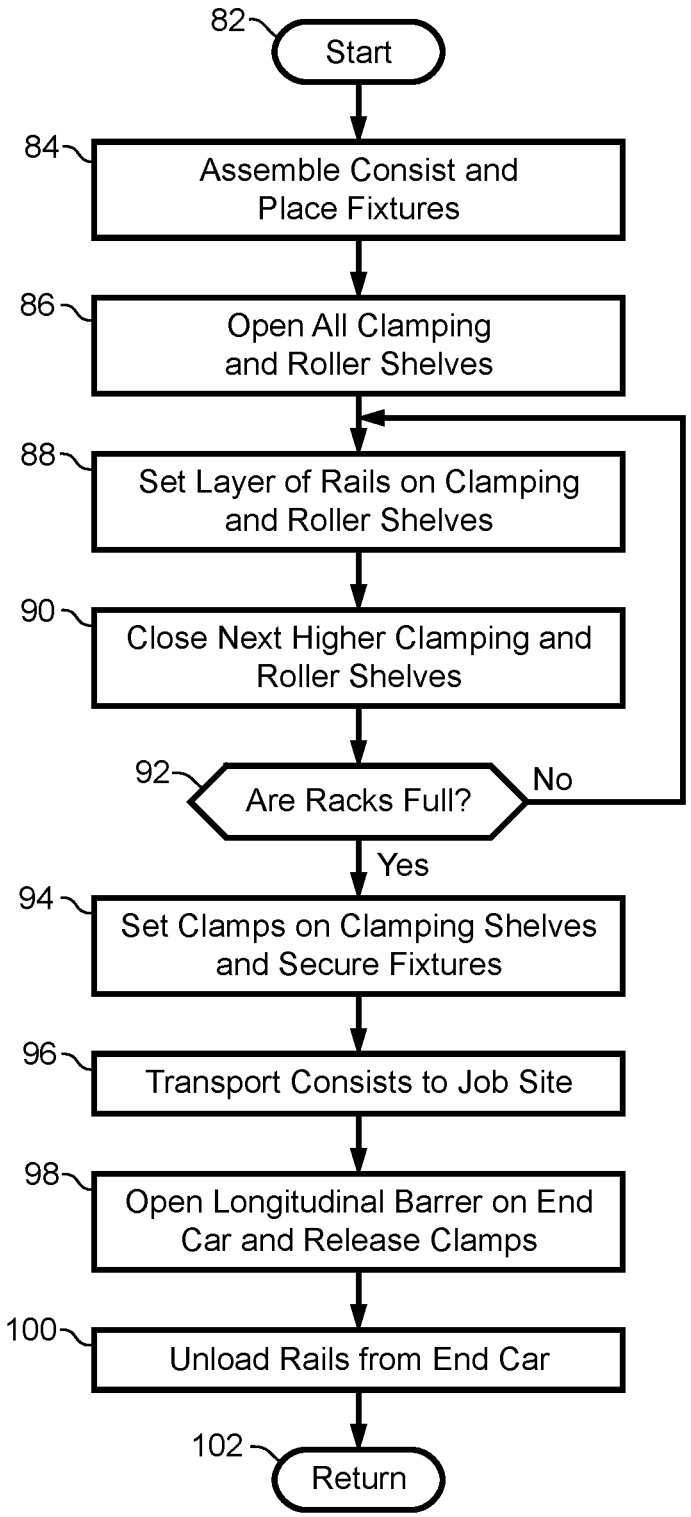
FIG. 17 is process flow diagram for loading and unloading a rail consist with continuous rail sections according to an illustrative embodiment of the present invention.

Reference is directed to FIG. 17, which is process flow diagram for loading and unloading a rail consist with continuous rail sections according to an illustrative embodiment of the present invention. The process begins at step 82 and proceeds to step 84 where a consist of five 86-foot rail flatcars are assembled, which may be joined together with drawbars as the consist travels as a unit. At this step, the various fixtures are, or have been, placed on the flatcars. This includes one or more rail securement racks, plural roller support racks, lateral barriers and longitudinal barriers at the ends of the consists. In preparation of loading rail sections onto the consist, at step 86, all of the rail clamping shelves and roller support shelves are moved to open positions. At step 88, a layer of rail sections is placed onto the clamping and roller shelves from above. At step 90, and next higher set of clamping and roller shelves are moved into their respective closed positions. At step 92, if all the racks are not full, then the process returns to step 88 where another layer and rail section are loaded onto the consist from above, and the process continues. On the other hand, at step 92, if the racks are full of rail sections, then the process continues to step 94.

Continuing with FIG. 17, at step 94, the clamps on all the clamping shelves are tightened to secure all the rail sections within the rail securement racks, and the fixtures are all secured in preparation of transport. At step 96, the consist is routed to a rail installation job site, ready for unloading and installation of the rail sections. At step 98, a longitudinal barrier at the end of the consist from which rail sections will be unloaded is opened, and the rail securement clamps are released. At step 100, the rail sections are drawn off the end of the consist. At step 102, the process returns.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. A consist of flatcars for transporting continuous rail sections greater in length than a single flatcar, and adapted for top loading and end unloading of the continuous rail sections, the consist comprising:

a tie-down flatcar having a rail securement rack, wherein said securement rack includes;

a) a support frame, vertically oriented and adapted for fixed connection to said tie-down flatcar;

b) a rail sill fixed adjacent a lower portion of said support frame, for supporting ones of the plural continuous rail sections on an upper surface thereof;

c) plural rail clamping shelves configured to selectively engage said support frame in a stacked manner above said rail sill, and wherein each of said plural rail clamping shelves includes a rail shelf having an upper surface for supporting ones of the plural continuous rail sections, and a rail clamp assembly attached to said rail shelf for retainably engaging ones of the plural continuous rail sections, said rail clamp assembly including a clamp carriage and a ramp drive assembly, and d) a cap rail clamp having like configuration as said rail clamp assembly, including said clamp carriage and said ramp drive assembly, but omitting an upper surface for supporting plural rail sections;

plural support flatcars engaged into the consist with said tie-down flatcar, wherein each of said plural support flatcars includes a roller support rack, wherein said roller support racks each includes;

e) a first rack support and a second rack support, both vertically oriented, and adapted for fixed connection to said support flatcar;

f) a roller sill disposed between said first rack support and said second rack support, and adjacent a deck surface of said support flatcar, having plural rollers disposed on an upper surface thereof for supporting plural rail sections;

g) plural roller shelves arranged in a vertical stack and pivotally supported from said first rack support about a vertical axis, each pivotable between an open position that enables loading of rail sections, from above, between said first and second rack supports, and a closed position where a distal end of each roller shelf engages said second rack support, and wherein each roller shelf further includes plural rollers positioned about an upper surface thereof to engage and support plural rail sections thereupon, and thereby enable longitudinal movement of the plural rail sections supported thereby, and, a fastening means disposed at said distal end, and adapted to fasten to said second rack support.

2. A consist of flatcars for transporting continuous rail sections greater in length than a single flatcar, and adapted for top loading and end unloading of the rail sections, the consist comprising:

a tie-down flatcar having a rail securement rack fixed thereto that includes a support frame having plural rail clamping shelves supported therefrom, wherein a portion of said rail clamping shelves are moveably engaged with said support frame between a first position enabling the placement of the rail sections from above the consist, and a second position generally orthogonal to the rail sections to facilitate support thereof, and wherein said rail clamping shelves include plural rail clamps positioned to engage and retain the rail sections in place during transit of the consist;

plural support flatcars engaged in the consist with said tie-down flatcar, wherein each of said plural support flatcars has a roller rack fixed thereto that includes plural roller shelves that each comprise plural rollers to engage and support the rail sections in a manner to enable movement of the rail sections along a longitudinal axis of the consist, and wherein said plural roller shelves are pivotally mounted to said roller racks between a loading position that provides clearance for placement of the rail sections from above the consist, and a transport position generally orthogonal to the rail sections to facilitate support thereof during transit and unloading of the consist.

3. The consist of flatcars for transporting continuous rail sections of claim 2, and wherein the rail sections are approximately 320-feet in length, and wherein:

said tie-down flatcar has two rail securement racks fixed thereto, and wherein said plural support flatcars particularly include two support flatcars, both coupled to said tie-down flatcar, and each having two of said roller racks fixed thereto, and further comprising;

two end flatcars, each coupled to one of said two support flatcars, and having fixed thereto at least one of said roller racks, and each of said two end flatcars having a longitudinal barrier fixed adjacent to an unconnected end thereof, said longitudinal barriers having a door therein operable to open to thereby enable said rail sections to be drawn off an end of the consist of flatcars.

4. A method of transporting continuous rail sections that are greater in length than a single flatcar, utilizing a consist of plural rail flatcars, which includes a tie-down flatcar and plural support flatcars, wherein the tie-down flatcar has a rail securement rack fixed thereto having a support frame for supporting a stack of plural rail clamping shelves that each include plural rail clamps, and wherein the plural support flatcars each have a roller rack fixed thereto having a stack of plural roller shelves pivotally coupled thereto that each include plural rollers to engage and support the continuous rail sections to enable longitudinal movement of the continuous rail sections, the method comprising the steps of:

removing the rail clamping shelves from the support frame;

pivoting open the stacks of plural roller support shelves to loading positions that provide clearance for placement of the continuous rail sections from above;

setting, from above the consist, the plural continuous rail sections on the rail securement rack and the roller racks of the plural support flatcars;

replacing a rail clamping shelf to the stack of plural rail clamping shelves;

closing a roller shelf in each of the stacks of plural roller shelves by pivoting to positions orthogonal to the continuous rail sections, thereby enabling the support of another layer of continuous rail sections;

repeating said setting, replacing, and closing steps until all of the stack of plural rail clamping shelves have been set and until the stack of plural roller shelves have been closed;

clamping the continuous rail sections to the rail securement rack by engaging the plural rail clamps with the plural continuous rail sections;

transporting the consist to a destination;

unclamping the continuous rail sections from the rail securement rack by disengaging the plural rail clamps from the plural continuous rail sections, and pulling the plural continuous rail sections from an end of the consist.

5. A rail securement rack for a tie down flatcar useful in a consist of flatcars for transporting plural continuous rail sections, the rail securement rack comprising:

a support frame, vertically oriented and adapted for fixed connection to the tie-down flatcar;

a rail sill fixed adjacent a lower portion of said support frame, for supporting plural rail sections on an upper surface thereof;

plural rail clamping shelves configured to selectively engage said support frame in a stacked manner above said rail sill, and wherein each of said plural rail clamping shelves further comprise:

a) a rail shelf having an upper surface for supporting plural rail sections;

b) a rail clamp assembly attached to said rail shelf for retainably engaging plural rail sections therebelow, each rail clamp assembly further comprising:

i) a clamp carriage having a ramp surface, and having plural rail clamps attached to a lower portion thereof for engaging the plural rail sections, and ii) a ramp drive assembly, disposed between said rail shelf and said clamp carriage, which includes a ramp drive actuator and a ramp driver arranged to engage said ramp surface such that actuation of said ramp drive actuator urges said plural rail clamps to retainably engage the plural rail sections, and a cap rail clamp having like configuration as said rail clamp assembly, including said clamp carriage and said ramp drive assembly, but omitting an upper surface for supporting plural rail sections.

6. The rail securement rack of claim 5, and further comprising:

plural rail flange spacers disposed upon said upper surface of said rail sill and disposed upon an upper surface of each of said rail shelves, to thereby separate adjacent pairs of the plural rail sections supported thereon.

7. The rail securement rack of claim 5, and further comprising: plural twistlock fasteners disposed between each of said plural rail clamping shelves and said support frame, to thereby enable selective engagement therebetween.

8. The rail securement rack of claim 5, and wherein:

said clamp carriage further comprises a second ramp surface opposingly aligned with said ramp surface of said clamp carriage, and wherein said ramp drive assembly further comprises a second ramp driver to correspondingly engage said second ramp surface.

9. The rail securement rack of claim 5, and wherein:

said clamp carriage further includes plural clamp bosses extending therefrom to support said plural rail clamps to thereby accommodate the height of the rail sections such that said plural rail clamps engage lower portions of the rail sections.

10. The rail securement rack of claim 5, and further comprising:

a ramp drive actuator lock disposed between said rail clamping shelf and said ramp drive actuator, to thereby enable selective locking of ramp drive actuation against movement of said ramp driver.

11. The rail securement rack of claim 5, and wherein:

said support frame comprises two side supports and one center support, all vertically oriented, and wherein said plural rail clamping shelves are disposed between said center support and one of said two side supports.

12. A roller support rack for a support flatcar having a deck, useful in a consist of flatcars for transporting plural continuous rail sections, the roller support rack comprising:

a first rack support and a second rack support, both vertically oriented, and adapted for fixed connection to the support flatcar;

a roller sill disposed between said first rack support and said second rack support, and adjacent the support flatcar deck, having plural rollers disposed on an upper surface thereof for supporting the plural continuous rail sections;

plural roller shelves arranged in a vertical stack and pivotally supported from said first rack support about a vertical axis, each pivotable between an open position that enables loading of the plural continuous rail sections, from above, between said first and second rack supports, and a closed position where a distal end of each roller shelf engages said second rack support, and wherein each roller shelf further includes;

a) plural rollers located upon an upper surface thereof to engage and support the plural continuous rail sections thereupon, and thereby enable longitudinal movement of the plural continuous rail sections supported thereby, and b) a means for fastening disposed at said distal end, and adapted to fasten to said second rack support.

13. The roller support rack of claim 12, and wherein:

said means for fastening is a twistlock fastener disposed between said distal end of said plural roller shelves and said second rack support.

14. The roller support rack of claim 12, and wherein:

said plural roller shelves further include plural rail flange spacers disposed upon said upper surface, to thereby separate the plural continuous rail sections supported thereon.

* * * * *